US005787737A

United States Patent [19]

Cho

[11] Patent Number: 5,787,737

[45] Date of Patent: Aug. 4, 1998

[54] BURGLAR-PREVENTING APPARATUS OF A CENTRAL PROCESSING UNIT

[75] Inventor: Duk-Soon Cho, Suwon, Rep. of Korea

[73] Assignee: SamSung Electronics Co., Ltd., Kyungki-do, Rep. of Korea

[21] Appl. No.: 662,381

[22] Filed: Jun. 12, 1996

[30] Foreign Application Priority Data

Jun. 15, 1995 [KR] Rep. of Korea ..... 1995/13567

[51] Int. Cl.[6] ..... E05B 69/00

[52] U.S. Cl. ..... 70/58; 70/158; 70/57

[58] Field of Search ..... 292/129, 98; 70/58, 70/158–160, 162

[56] References Cited

U.S. PATENT DOCUMENTS

| | | | |
|---|---|---|---|
| 826,343 | 7/1906 | Mason | 292/129 |
| 1,302,168 | 4/1919 | Hughes | 292/129 |
| 2,507,196 | 5/1950 | Dall | 292/129 |
| 5,152,496 | 10/1992 | Kobayashi | 70/58 |
| 5,446,618 | 8/1995 | Tetsuya et al. | 70/58 |

*Primary Examiner*—Steven N. Meyers
*Assistant Examiner*—Tuyet-Phuong Pham
*Attorney, Agent, or Firm*—Robert E. Bushnell, Esq.

[57] ABSTRACT

A device for the chassis of a computer case that prevents unauthorized access to the internal components thereof is disclosed. The device includes a 'U' shaped member, positioned primarily inside the chassis, such that if one arm is pulled forward against a spring bias through an aperture in the chassis by a user, the other arm of the 'U' fastens the cover of the computer case to the base. In addition, an a hole positioned near the tip of the arm that is pulled through the aperture to allow the user to attach a locking mechanism to the fastening device, thus preventing the disengagement and the opening up of the computer case by others. As a result, expensive electrical components located inside the chassis, including a CPU, will not be accessible to outsiders. The user is free to select the type of locking mechanism that is attached to the fastening device. When unlocked and released from the user's fingers, the spring bias causes the fastening member to retreat almost entirely inside the aperture of the chassis, thus concealing the hole is that used to fit the shackle of the lock.

18 Claims, 4 Drawing Sheets

BURGLAR-PREVENTING APPARATUS OF A CENTRAL PROCESSING UNIT

CROSS-REFERENCE TO RELATED APPLICATIONS

This application makes reference to, incorporates the same herein, and claims all benefits accruing under 35 U.S.C. §119 arising from an application for a *Burglar-Preventing Apparatus of a Central Processing Unit* earlier filed in the Korean Industrial Property Office on 15 Jun. 1995 and there duly assigned Ser. No. 13567/1995.

FIELD OF THE INVENTION

The present device relates to a locking mechanism that prevents thiefs or unauthorized personnel from gaining access to expensive components located on the inside of a computer chassis. The device allows the user a wide range in latitude in selecting the type of lock used to protect the internal components.

BACKGROUND OF THE INVENTION

Theft prevention devices that deny access to the interior of compartments appears in many forms in the prior art, including in the application to computers. For example, U.S. Pat. No. 5,228,319 for a *Desktop Computer Locking Assembly* to Holley et al. discloses a desktop computer locking assembly that is capable of locking a cover to the chassis of a computer by using a hasp, a staple, and a padlock. A staple is monolithically integrated to a bracket piece which connects the cover to the chassis. The bracket is fixedly mounted on a hasp portion of a chassis, and a shackle containing padlock locks onto the aperture of the staple locking together the cover to the chassis.

Another application to computers is found in U.S. Pat. No. 5,400,622 for a *Locking Device for Floppy Disk Drive* to Harmon which discloses the use of a shackle containing padlock to prevent theft of data from a disk drive. A pair of slats, each containing an aperture and a pair of pins, are inserted into a disk drive and rotated so that a pair of pins become captive within the disk drive and that the pair of apertures become coincident and external to the disk drive to accommodate a shackle of a padlock.

Non computer applications include U.S. Pat. No. 5,284,036 for a *Tamper-Resistant Security Lock for Cargo Container Doors* to Rosenbaum which discloses a security lock system for cargo container doors. A padlock containing a shackle is used to lock a rotatable staple with an aperture pivotably inserted into a hasp. The rotatable staple is connected to the cover piece and the hasp is the bottom piece, thus causing the cover and the bottom to be locked together when the padlock locks the aperture containing staple after the staple is inserted into the hasp. Finally, the use of a rectilinear slot to slidably attach a shaft of another part in a locking mechanism is found in U.S. Pat. No. 4,882,655 for a *Device for Locking an Electronic Equipment Housing on a Tray* to Pavie, which discloses a device for locking electronic equipment onto a tray. A rectilinear slot is used to slide a carriage between a locked and an unlocked position.

Although the use of padlock like locking mechanisms has been used to lock the chassis of a computer, I have not seen the use of a 'U' shaped rectilinearly slidable fastening part. I have also not seen an engagement mechanism where the cover is attached to the base by inserting one arm of the fastening device into coincident apertures where a portion of the cover is layered over a portion of the base.

SUMMARY OF THE INVENTION

It is therefore an object to present a locking device for a computer chassis that is made of a 'U' shaped part that is slidably attached to a part fixedly attached to the chassis.

It is also an object to provide a fastening device that engages the cover to the base of the chassis by inserting one arm of a 'U' shaped fastening part into an aperture formed where the cover part is layered on top of the base part.

It is another object to provide a spring bias to the fastening part so that it is biased to a disengaged position where it is not possible to secure a lock to said fastening device.

It is also an object to allow a user to pull one arm of said 'U' shaped fastening device rectilinearly and against the spring bias and through the aperture so that the cover is engaged to the base and so that it is possible to affix a locking mechanism onto the pulled arm thus preventing the disengagement of the cover from the base.

These and other objects may be achieved by a locking mechanism that contains a 'U' shaped fastening part that contains two arms, where one of the two arms can be pulled against a spring bias through an aperture towards the outside of the chassis causing the cover and to the base to be secured together and enabling the user to attach a lock to the arm that was pulled thus locking the fastening part so that the cover is locked to the base. The engagement of the cover to the base is caused by inserting a second arm through an aperture made up of a cover portion layered on top of a base portion. To unlock, the user removes the lock from the fastening part, then releases the fastening part so that the fastening part retreats via a spring bias to the interior of the device causing the second arm to disengage the cover from the base and the first arm to be obscured so that a user may not attach a lock thereto. The mechanism allows the user to choose from a wide range of locks that can be attached to the fastening part when pulled. Thus, a lock can be selected to suit the user's needs.

DETAILED DESCRIPTION OF THE INVENTION

Figure 1:
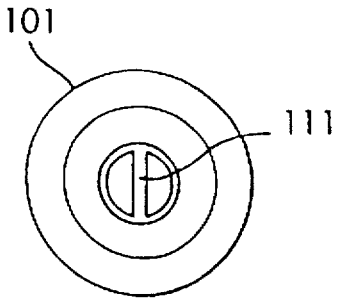
FIG.1 PRIOR ART
FIG. 1 is a plan view of a prior art locking equipment for a burglar-preventing apparatus of a CPU.
Figure 2:
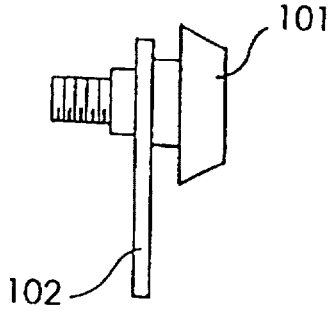
FIG.2 PRIOR ART
FIG. 2 is a cross-sectional view of a prior art locking equipment for a burglar-preventing apparatus of a CPU.
Figure 3:
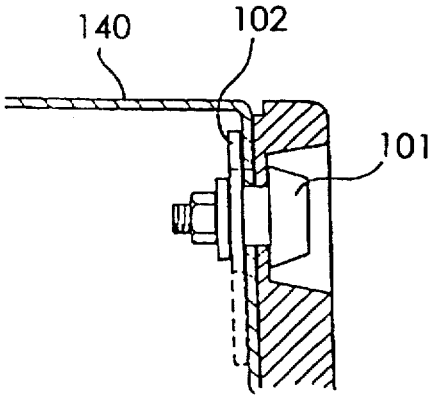
FIG.3 PRIOR ART
FIG. 3 is a cross-sectional view of a prior art locking equipment for a burglar-preventing apparatus of a CPU connected with a computer case.
Figure 4:
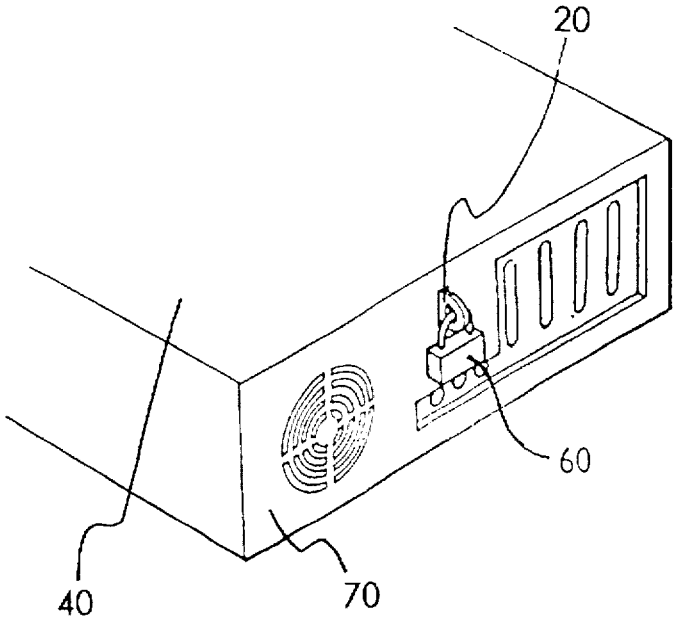
FIG. 4 is a perspective view of a computer body installed with a burglar-preventing apparatus of a CPU according to an embodiment of the present invention.

FIGS. 1 through 3 show the locking mechanism used in the prior art. Body 101 has a groove 111 that a key fits onto, and lever 102 which rotates by user's locking or unlocking action.

The above referenced locking mechanism works as follows. A key is inserted into groove 111 of computer body 101 and is rotated while the locking equipment is installed at a computer case 140. The above-mentioned rotary motion of the key makes lever 102 inside the computer case revolve. That is, the location of lever 102 varies according to the rotary motion of body 101. The location of lever 102 dictates whether computer case 140 is in a locked state or an unlocked state.

However, as the above-mentioned prior art burglar preventing apparatus of a CPU is made by specialized manufacturers regardless of user's taste, there are problems that the shapes of locking equipments are identical, the price is high, and in case that a user lost the key, the computer case must be taken to pieces.

Figure 9:
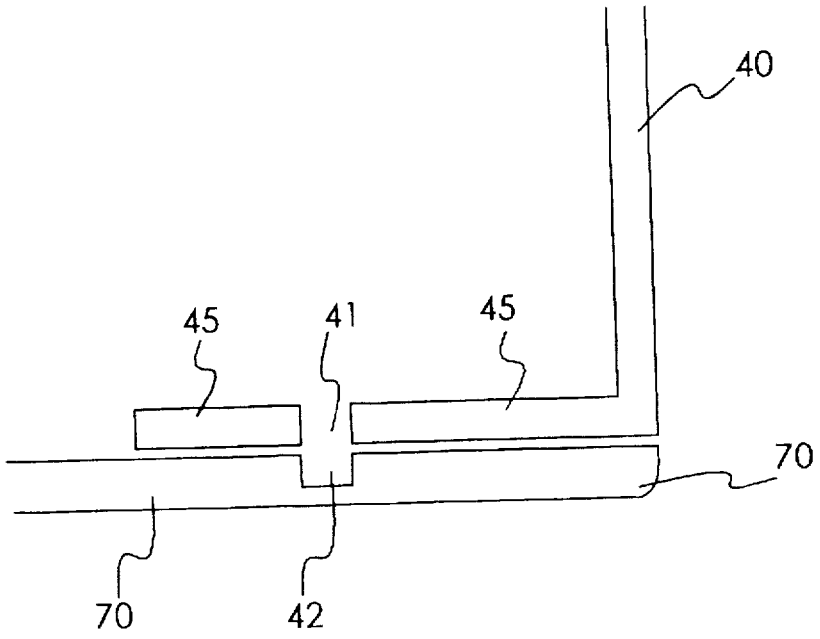
FIG. 9 is a cross section of FIG. 5 taken along AA' showing where the second arm of the 'U'-shaped member engages the cover to the rear panel of the computer chassis.
Figure 5:
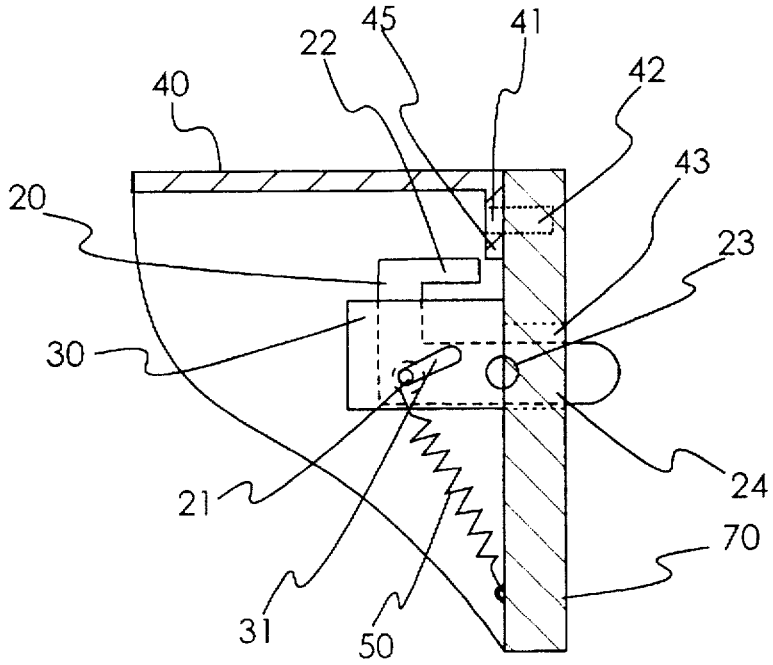
FIG. 5 is a cross-sectional view before fastening the locking equipment of a burglar-preventing apparatus of a CPU according to an embodiment of the present invention.
Figure 6:
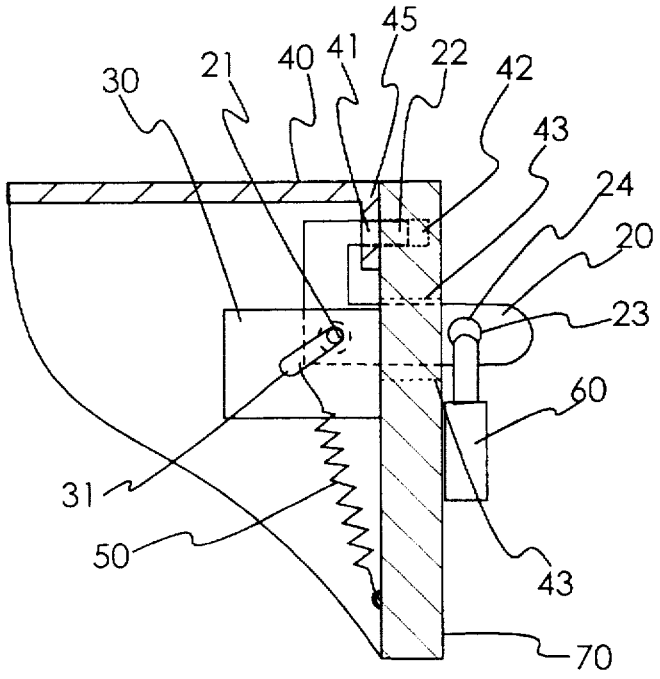
FIG. 6 is a cross-sectional view after fastening the locking equipment of a burglar-preventing apparatus of a CPU according to an embodiment of the present invention.
Figure 7:
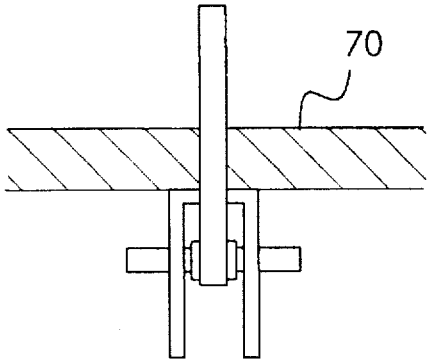
FIG. 7 is a plan view of a burglar-preventing apparatus of a CPU according to an embodiment of the present invention.
Figure 8:
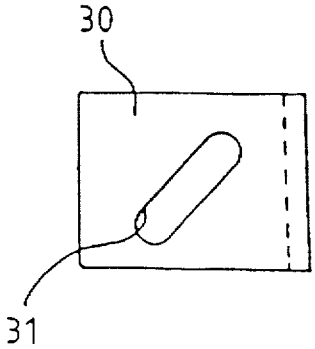
FIG. 8 is a side view of a bracket of a burglar preventing apparatus of a CPU according to an embodiment of the present invention.

FIGS. 4 through 8 depict a burglar-preventing apparatus for protecting electrical components including a CPU found inside a computer chassis according to the present invention. Included in the apparatus is 'U'-shaped member or J-shaped hook 20 having a first arm or proximal arm 24 and a second arm or distal leg 22 connected by an intermediate arm to the first arm, where the first arm is longer than second arm 22 and first arm 24 contains aperture 23 near the tip. 'U' shaped member 20 can slide rectilinearly by the user. Also included is rectangular member or support 30 fixedly attached and extending perpendicularly to the interior sidewall of the rear panel 70 of the computer chassis, rectangular member 30 perforated by an elongated aperture or groove 31 which defines the direction and distance that 'U'-shaped member 20 can translate to. First arm 24 slides through aperture 43 of rear panel 70, second arm 22 slides through aperture 41 in flange 45 of cover 40, and into groove or recess 42 of rear panel 70 directly underneath aperture 41 in flange 45. See FIG. 9. Thus, second arm 22 engages cover 40 to rear panel 70 of the chassis. Finally, spring 50, tied to inside of rear panel 70 at one end, and to 'U'-shaped member 20 at the other end, pulls and biases 'U'-shaped member 20 towards the interior of the computer chassis, causing aperture 23 on first arm 24 to be totally obscured from view by aperture 43 in rear panel 70.

The operation of the locking apparatus will now be described. The apparatus is initially in the unlocked state shown in FIG. 5. The user then grabs first arm 24 of 'U' shaped member 20, and pulls it towards him. This causes shaft, bass, or protrusion 21 of 'U' shaped member 20 to move along elongate aperture 31 of rectangular member 30 and causes 'U' shaped member 20 to move against the bias of spring 50 so that aperture 23 of first arm 24 emerges completely on the exterior side of aperture 43 of rear panel 70 of the computer chassis. As this pulling motion occurs, second arm 22 of 'U' shaped member 20 is inserted through aperture 41 of flange 45 of cover 40. Second arm 22 is then inserted into groove 42 in rear panel 70 of the computer chassis. Thus, cover 40 is engaged to the chassis at rear panel 70. Before releasing first arm 24 of 'U' shaped member 20, the user installs the shackle of lock 60 into aperture 23 and locks lock 60. With cover 40 engaged to the chassis, unauthorized persons will be denied access to the internal components of the computer chassis. See FIG. 6.

To unlock, the sequence of events occur in reverse order. First, the user unlocks lock 60. Next, the user removes the shackle of lock 60 from aperture 23. After the shackle is removed, the user releases first arm 24 of 'U' shaped member 20. This allows spring 50 to retract first arm 24 so that aperture 23 lies completely inside aperture 43 in rear panel 70. Simultaneously, shaft 21 of 'U' shaped member 20 slides along 22 to withdraw from both groove 42 in rear panel 70 and aperture 41 in flange 45 of cover 40, thus disengaging cover 40 from rear panel 70 of the computer chassis. See FIG. 5.

The effects of the burglar-preventing apparatus of a CPU achieved by the above-mentioned invention are that the expensive CPU can be protected safely; a user can select a locking equipment suited to his taste; and the computer case does not have to be dissolved in case that the key was lost when the locking equipment is locked.

What is claimed is:

1. A burglar-preventing apparatus of a CPU, comprising:

a computer chassis containing a rear panel having an inside side and an outside side;

a 'U' shaped member having a first arm longer than a second arm, said first arm perforated by an aperture, said first arm having a tip with a shaft extending perpendicular to said 'U' shaped member;

a rectangular shaped member fixedly attached to the inside side of said rear panel of said chassis, and extending perpendicular and inward from said inside side of said rear panel of said chassis, said rectangular shaped member perforated by an elongated rectilinear aperture that accommodates said shaft of said 'U' shaped member;

biasing means for pulling said 'U' shaped member entirely inside said chassis;

said rear panel of said computer chassis, perforated by a vertical slot that accommodates said first arm of said 'U' shaped member, and a groove directly above said vertical slot to accommodate said second arm of said 'U' shaped member; and a top cover that extends over a top of said computer chassis and containing a flange that fits on the inside side and across the top of said rear panel of said computer chassis, said flange containing an aperture that lies coincident to said groove in said inside side of said rear panel of said computer chassis, said aperture accommodates said second arm of said 'U' shaped member, wherein said 'U' shaped member engages said cover to said rear panel of said computer chassis when said first arm of said 'U' shaped member is pulled through said slot perforating said rear panel.

2. The burglar-preventing apparatus of a CPU of claim 1 wherein said 'U' shaped member is slidably attached to said rectangular shaped member.

3. The burglar-preventing apparatus of a CPU of claim 1 wherein said shaft of said 'U' shaped member may move rectilinearly along said elongated aperture in said rectangular shaped member, causing said 'U' shaped member to move rectilinearly.

4. The burglar-preventing apparatus of a CPU of claim 1, wherein said biasing means is comprised of an elastic spring connected between said inside side of said rear panel and said 'U' shaped member.

5. The burglar-preventing apparatus of a CPU of claim 1 wherein said aperture in said first arm of said 'U' shaped member is located near the tip of said first arm and can accommodate a shackle of a padlock.

6. The burglar-preventing apparatus of a CPU of claim 5 further comprising a padlock with a shackle, said shackle is inserted into said aperture perforating said first arm of said 'U' shaped member when said first arm of said 'U' shaped member is pulled through said vertical slot in said rear panel of said chassis, said padlock engaging and locking said cover to said chassis.

7. The burglar-preventing apparatus of a CPU of claim 1 wherein said second arm of said 'U' shaped member engages said cover to said chassis when inserted through said aperture perforating said flange of said cover and into said groove on said inside side of said rear panel of said chassis.

8. A housing for electronic components; comprising:

a chassis bearing a recess and being perforated by a first aperture spaced-apart from said recess;

a cover having a flange forming a mating engagement with said chassis forming a casement enclosing any electronic components borne by said chassis, with said flange being perforated by a second aperture aligned with said recess during said engagement;

a J-shaped hook having a distal leg connected by an intermediate arm to a proximal leg perforated by a third aperture, and having a first position during said engagement with said distal leg extending through said second aperture and resting inside said recess while said proximal leg extends through said first aperture and positions said third aperture outside of said casement;

a support attached to one of said chassis and said cover, slidably engaging said hook while accommodating reciprocating travel of said proximal leg through said first aperture while said hook moves between said first position and a second where said distal leg is disengaged from said recess and said third aperture is drawn within said casement.

9. The housing of claim 8, further comprising a lock passing through said third aperture while said distal leg engages said recess.

10. The housing of claim 8, further comprised of:

said hook bearing a boss extending transversely to a plane of said reciprocating travel; and said support bearing a groove receiving said boss and accommodating said reciprocating travel while said boss completes a transit of said groove as said hook moves between said first position and said second position.

11. The housing of claim 10, further comprised of a spring biasing said hook into said second position.

12. The housing of claim 10, further comprised of a spring biasing said hook into one of said first position and said second position.

13. The housing of claim 8, further comprised of a spring biasing said hook into said second position.

14. The housing of claim 8, further comprised of a spring biasing said hook into one of said first position and said second position.

15. A housing for electronic components; comprising:

a chassis bearing a recess and being perforated by a first aperture spaced-apart from said recess;

a cover having a flange forming a mating engagement with said chassis forming a casement enclosing any electronic components borne by said chassis, with said flange being perforated by a second aperture aligned with said recess during said engagement;

a hook having a distal leg connected by an intermediate arm to a proximal leg perforated by a third aperture, and having a first position during said engagement with said distal leg extending through said second aperture and resting inside said recess while said proximal leg extends through said first aperture and positions said third aperture outside of said casement;

a support attached to said chassis, slidably supporting said hook and accommodating travel of said proximal leg through said first aperture while said hook moves between said first position and a second where said distal leg is absent from within said recess and said third aperture is drawn within said casement.

16. The housing of claim 15, further comprised of:

a first one of said hook and said support bearing a protrusion extending transversely to a plane of said reciprocating travel; and a second and different one of said hook and said support bearing a groove receiving said protrusion and accommodating said reciprocating travel while said protrusion completes a transit of said groove as said hook moves between said first position and said second position.

17. The housing of claim 16, further comprised of a spring biasing said hook into said second position.

18. The housing of claim 15, further comprised of a spring biasing said hook into said second position.

* * * * *